US011521583B1

(12) United States Patent
Judson et al.

(10) Patent No.: US 11,521,583 B1
(45) Date of Patent: Dec. 6, 2022

(54) DEVICE THAT ATTACHES TO STRINGED INSTRUMENTS PREVENTING THE BOW FROM PLAYING OVER THE FINGERBOARD

(71) Applicant: Bow Restrictor, LLC, San Antonio, TX (US)

(72) Inventors: George Judson, San Antonio, TX (US); Alex Villareal, San Antonio, TX (US)

(73) Assignee: Bow Restrictor, LLC, San Antonio, TX (US)

( * ) Notice: Subject to any disclaimer, the term of this patent is extended or adjusted under 35 U.S.C. 154(b) by 0 days.

(21) Appl. No.: 17/357,422

(22) Filed: Jun. 24, 2021

Related U.S. Application Data

(60) Provisional application No. 63/136,849, filed on Jan. 13, 2021, provisional application No. 63/043,419, filed on Jun. 24, 2020.

(51) Int. Cl.
*G10D 3/166* (2020.01)
*G10D 3/06* (2020.01)
*G10D 1/02* (2006.01)

(52) U.S. Cl.
CPC ..... *G10D 3/166* (2013.01); *G10D 1/02* (2013.01); *G10D 3/06* (2013.01)

(58) Field of Classification Search
CPC ..... G10D 3/166; G10D 3/06; G10D 1/02
See application file for complete search history.

(56) References Cited

U.S. PATENT DOCUMENTS 663,187 A * 12/1900 Rupp ..... G10D 3/06 84/314 R
713,171 A * 11/1902 Strauss et al. ..... G10D 3/166 84/283
766,549 A * 8/1904 Strauss et al. ..... G10D 3/166 84/283
987,061 A * 3/1911 Garrett ..... G10D 3/166 84/283
1,192,030 A * 7/1916 Ashley ..... G10D 3/166 84/283
1,228,949 A * 6/1917 Mollenhauer ..... G10D 3/166 84/283
1,325,251 A * 12/1919 Keles ..... G10D 3/166 84/283
1,351,570 A * 8/1920 Hewitt ..... G10D 3/06 984/115
1,603,371 A * 10/1926 Zahn ..... G10D 3/166 984/122
1,623,633 A * 4/1927 Morris ..... G10D 3/166 984/122

(Continued)

FOREIGN PATENT DOCUMENTS

GB 2370677 A * 7/2002 ..... G10D 3/166
JP 2002062867 A * 2/2002

*Primary Examiner* — Robert W Horn
(74) *Attorney, Agent, or Firm* — William H. Quirk; Alexander J. Antonio; Rosenthal Pauerstein Sandoloski Agather, LLP

(57) ABSTRACT

A device that attaches to stringed instruments, preventing the bow from playing over the fingerboard, is disclosed. The device aids in developing proper bow technique, and only restricts movement of the bow over the fingerboard without restricting movement elsewhere between the fingerboard and the bridge.

17 Claims, 10 Drawing Sheets

(56) References Cited

U.S. PATENT DOCUMENTS

| | | | | | |
|---|---|---|---|---|---|
| 1,639,345 | A * | 8/1927 | Lasco | G10D 3/166 | 84/283 |
| 1,723,266 | A * | 8/1929 | Caruso | G10D 3/166 | 984/122 |
| 1,789,210 | A * | 1/1931 | Auensen | G10D 3/166 | 984/122 |
| 2,240,696 | A * | 5/1941 | Gusman | G10D 3/166 | 84/281 |
| 2,782,670 | A * | 2/1957 | Lipski | G10D 3/166 | 984/122 |
| 3,169,438 | A * | 2/1965 | Belcher | G10D 3/166 | 984/122 |
| 3,306,150 | A * | 2/1967 | Phillips | G10D 3/166 | 984/122 |
| D239,406 | S * | 3/1976 | Gordon | D17/20 | |
| 3,987,700 | A * | 10/1976 | Dunlap | G10D 3/166 | 984/122 |
| 4,222,302 | A * | 9/1980 | Sanfilippo | G10D 3/166 | 984/122 |
| 4,854,212 | A * | 8/1989 | Levin | G10D 3/166 | 984/122 |
| D322,270 | S * | 12/1991 | Concoff | 84/283 | |
| 5,301,589 | A * | 4/1994 | Spadafora | G10D 3/166 | 84/283 |
| 7,605,317 | B2 * | 10/2009 | Chen | G09B 15/06 | 84/283 |
| 9,190,035 | B1 * | 11/2015 | Ranck Fields | G10D 1/02 | |
| 2004/0237751 | A1 * | 12/2004 | Foxwell | G10D 3/166 | 84/283 |
| 2006/0278063 | A1 * | 12/2006 | Liao | G09B 15/06 | 84/465 |

* cited by examiner

DEVICE THAT ATTACHES TO STRINGED INSTRUMENTS PREVENTING THE BOW FROM PLAYING OVER THE FINGERBOARD

CLAIM OF PRIORITY TO PRIOR APPLICATIONS

This application claims the benefit of the filing date of U.S. Provisional Application Ser. No. 63/043,419, filed on Jun. 24, 2020, entitled "Device That Attaches to Stringed Instruments Preventing the Bow from Playing Over the Fingerboard", as well as the entire disclosure of which is hereby incorporated by reference into the present disclosure. Additionally, this application hereby incorporates by reference U.S. Provisional Application Ser. No. 63/136,849, filed on Jan. 13, 2021, entitled "Device That Attaches to Stringed Instruments Preventing the Bow from Playing Over the Fingerboard".

FIELD OF THE INVENTION

The present invention relates generally to an attachment for stringed instruments, and more particularly to an attachment that properly restricts a bow from traveling onto a fingerboard without excessively restricting the player's movement.

BACKGROUND

An almost universal problem exists among beginning orchestral strings players in that while they are developing consistent bowing technique, their arm and bow slide outside of the bowing region and over the fingerboard. Instead of bowing perpendicular to the strings, the bow slides parallel to the strings which creates an unpleasant sound when performing or practicing. Proper technique generally requires the bow to be used on the strings in the area between the bridge and the fingerboard. For many, this stage of learning can last several months and may discourage the player from learning the instrument all together. Beginning orchestral string players turn to aids in many forms to overcome the difficulties of learning a new instrument, so they can competently practice or share their progress with friends or relatives in a pleasant manner.

In the field of the present invention, despite long availability of attaching devices in general, such designs can be large, cumbersome, and can make the experience of playing a stringed instrument unpleasant. Prior designs attach to the sides of the instrument and may cause marks or other damage to the instrument in the course of application or removal. Additionally, other designs can excessively restrict the movement of the bow within the proper playing area between the fingerboard and bridge of the instrument.

Therefore, despite the availability of prior designs, there are still substantial and long-felt unresolved needs for a compact device that aides in developing proper bow technique without unduly restricting movement otherwise.

BRIEF SUMMARY OF THE INVENTION

Disclosed embodiments provide an unobtrusive attachment device that is compact, adjustable, easy to use, and safe to attach to a variety of stringed instruments. Furthermore, disclosed embodiments offer a product that is simple to manufacture cost effectively.

To those ends, among others, the disclosed embodiments include a means for orchestra strings players to practice and perform with proper bow placement without unduly restrictive movement. Disclosed embodiments provide a barrier that keeps the bow between the fingerboard and the bridge to allow optimal sound when practicing or performing with a stringed instrument. The bow restricting device is made with Acrylonitrile butadiene styrene (ABS) but could also be made of wood or metal or other plastic.

An objective of the present invention is to offer a device that can be quickly and easily by attach to a stringed instrument without causing damage to said instrument. Disclosed embodiments are customizable and fit a variety of stringed instruments and allow the player to adjust the restricting rods to the desired location.

Another objective of the present invention is to aid in developing the proper bow technique. Disclosed embodiments aid in the placement of the bow and keeping the bow straight while playing a stringed instrument.

Preferred embodiments have an attachment device that is configurable to securely fit a variety of stringed instruments. Alternate embodiments use a spring-loaded clamp with rubber pads that can quickly be attached or removed from an instrument.

The disclosure, including descriptions, drawings, and claims, describes one or more embodiments of the invention. Many other features, objectives, and advantages of the invention will be apparent to one of ordinary skill in the art from the disclosure. Given the disclosure, especially in light of the prior art, it is another objective of the invention to improve upon, and overcome the inefficiencies, limitations, and constraints of, the prior art.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIGS. 8A & 8B are drawings of an alternate embodiment of the bow restricting device 10 with a straight restrictor rod 14.

DETAILED DESCRIPTION OF PREFERRED EMBODIMENTS

The disclosures of this patent application, including the descriptions, drawings, and claims, describe one or more embodiments of the invention in more detail. Many other features, objects, and advantages of the invention will be apparent from these disclosures to one of ordinary skill in the art, especially when considered in light of a more exhaustive understanding of the numerous difficulties and challenges faced by the art. While there are many alternative variations, modifications and substitutions within the scope of the invention, one of ordinary skill in the art should consider the scope of the invention from a review of any claims that may be appended to applications and patents based hereon, including any amendments made to those claims in the course of prosecuting this and related applications.

Bow Restricting Device

Figure 1:
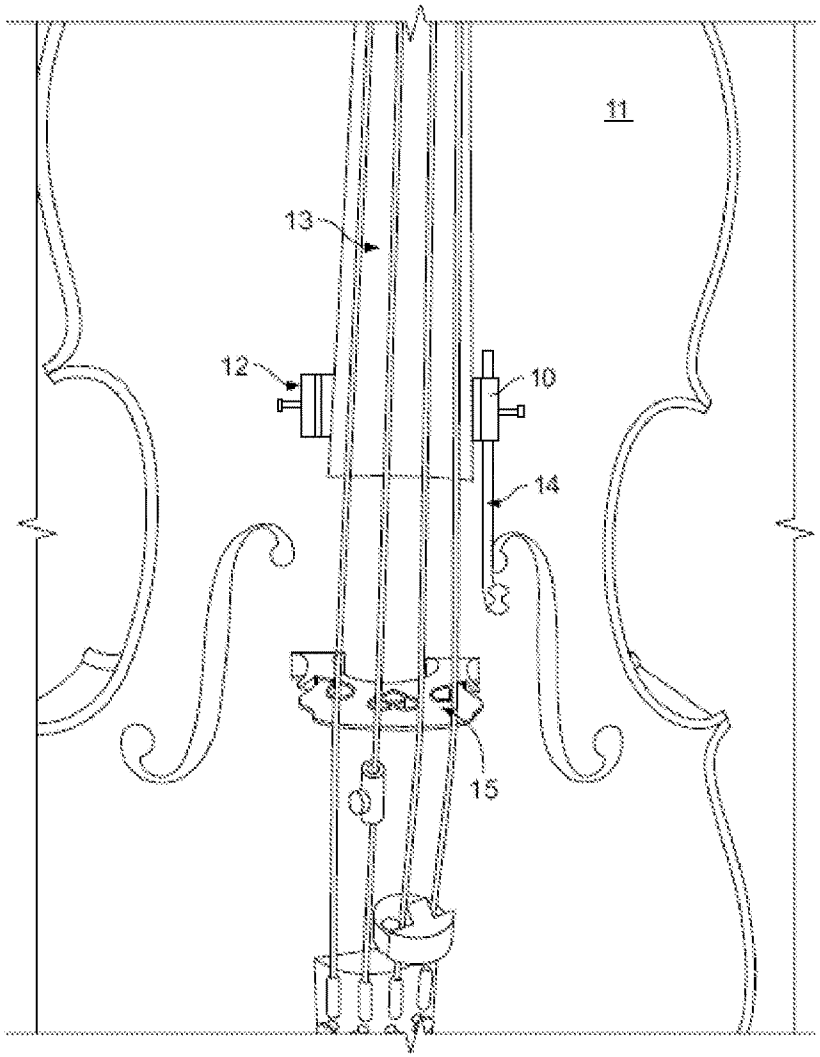
FIG. 1 illustrates an embodiment of the bow restricting device 10 attached to a stringed instrument 11.

Starting with FIG. 1, there is shown a preferred embodiment of the bow restricting device 10 attached to a stringed instrument 11, a cello in this case. Preferred embodiments of the bow restricting device 10 attach to the fingerboard 13 of a string instrument 11. An attaching component 12 secures the bow restricting device 10 to the fingerboard 13, and a restricting rod 14 protrudes from the device 10 to the desired length. The restricting rod 14 prevents the bow from traveling beyond that point when playing the instrument and keeps the bow in the desired position between the fingerboard and the bridge 15 of the stringed instrument 11.

Figure 2:
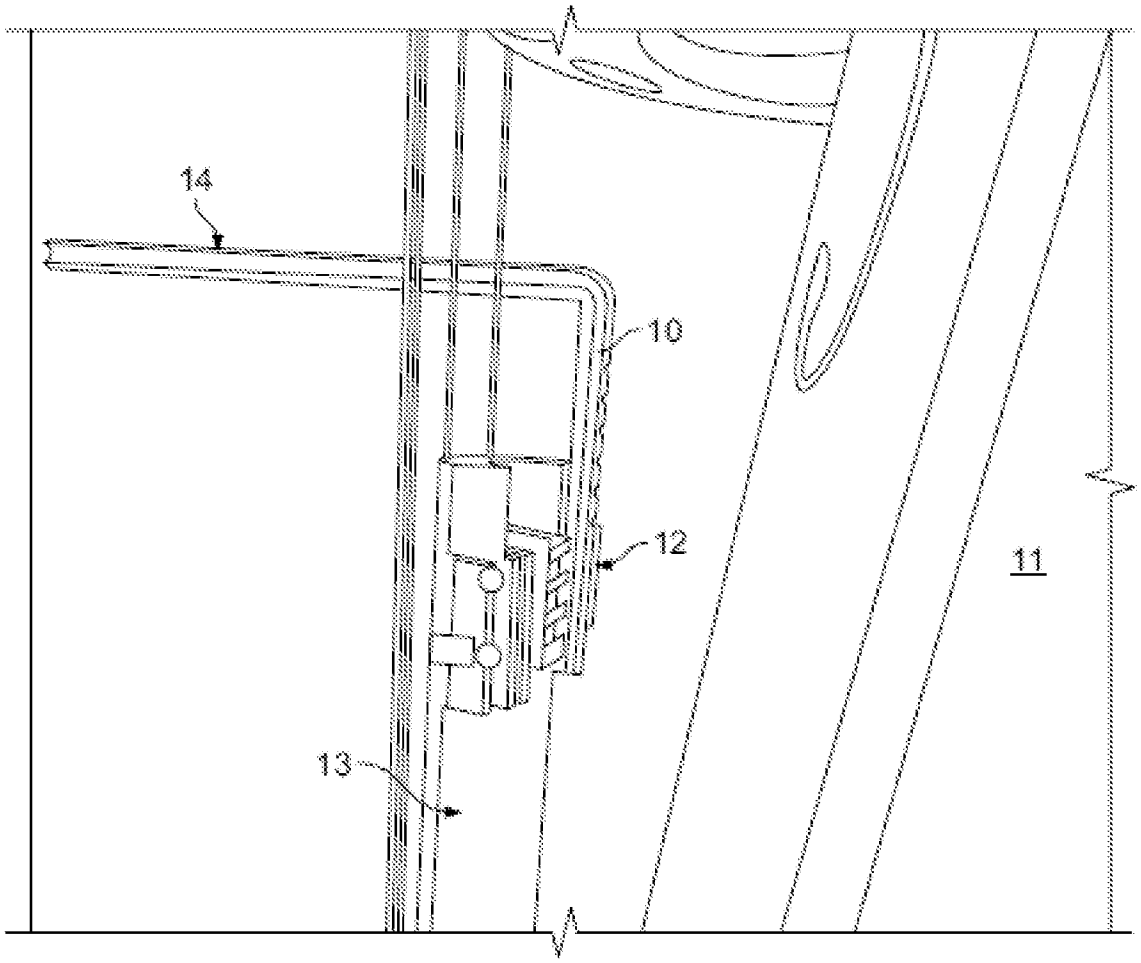
FIG. 2 illustrates another view of an embodiment of the bow restricting device 10 attached to a stringed instrument 11.

Turning to FIG. 2, there is shown an alternate view of a preferred embodiment of the bow restricting device 10 attached to a stringed instrument 11 with the attaching component 12. As illustrated, a bow would not be able to travel beyond the restricting rod 14 preventing the playing over the fingerboard 13. The device 10 is unobtrusive in that it only restricts movement of the bow over the fingerboard 13 without restricting movement elsewhere and is barely visible to an audience. Further, the device 10 is easy to attach to a variety of stringed instruments 11 without causing damage and is customizable to place in the desired location by the player. Preferred embodiments of the bow restricting device 10 are made with light weight material, such as, acrylonitrile butadiene styrene (ABS) but could also be made of wood or metal or other plastic.

Those skilled in the art will recognize that FIGS. 1 & 2 are for illustrative purposes and provide an example of a preferred embodiment in use and are non-limiting examples. A variety of configurations material and components can be used on a variety of stringed instruments 11 to achieve the same effect.

Preferred Embodiment

Figure 3B:
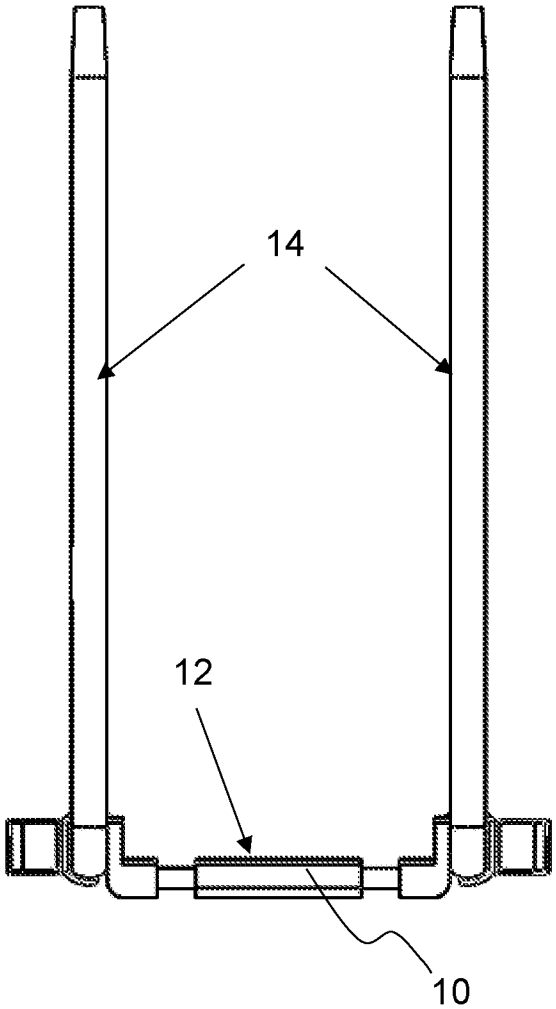
FIGS. 3A & 3B are drawings of a preferred embodiment of the bow restricting device 10.
Figure 3A:
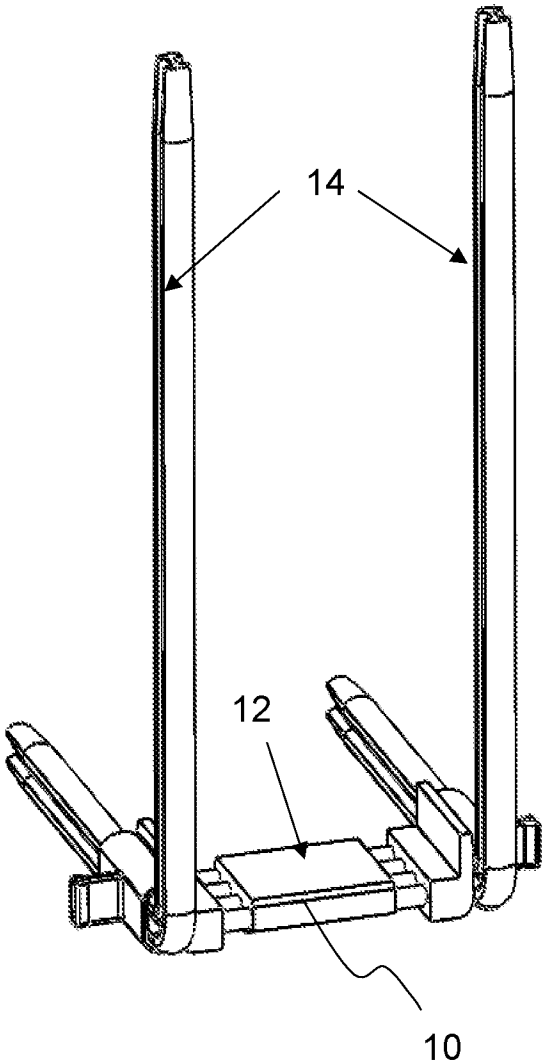

Turning now to FIGS. 3A & 3B, there is shown a drawing of two views of the preferred embodiment of the bow restricting device 10. There are two restricting rods 14 attached to the attachment component 12 in this configuration. Two restricting rods 14 can be attached to the attachment component 12 to further limit the distance the bow can drift when playing a stringed instrument 11. The restricting rods 14 can be placed at the desired locations independently to allow the player the choose the optimal preferred distance.

Figure 4A:
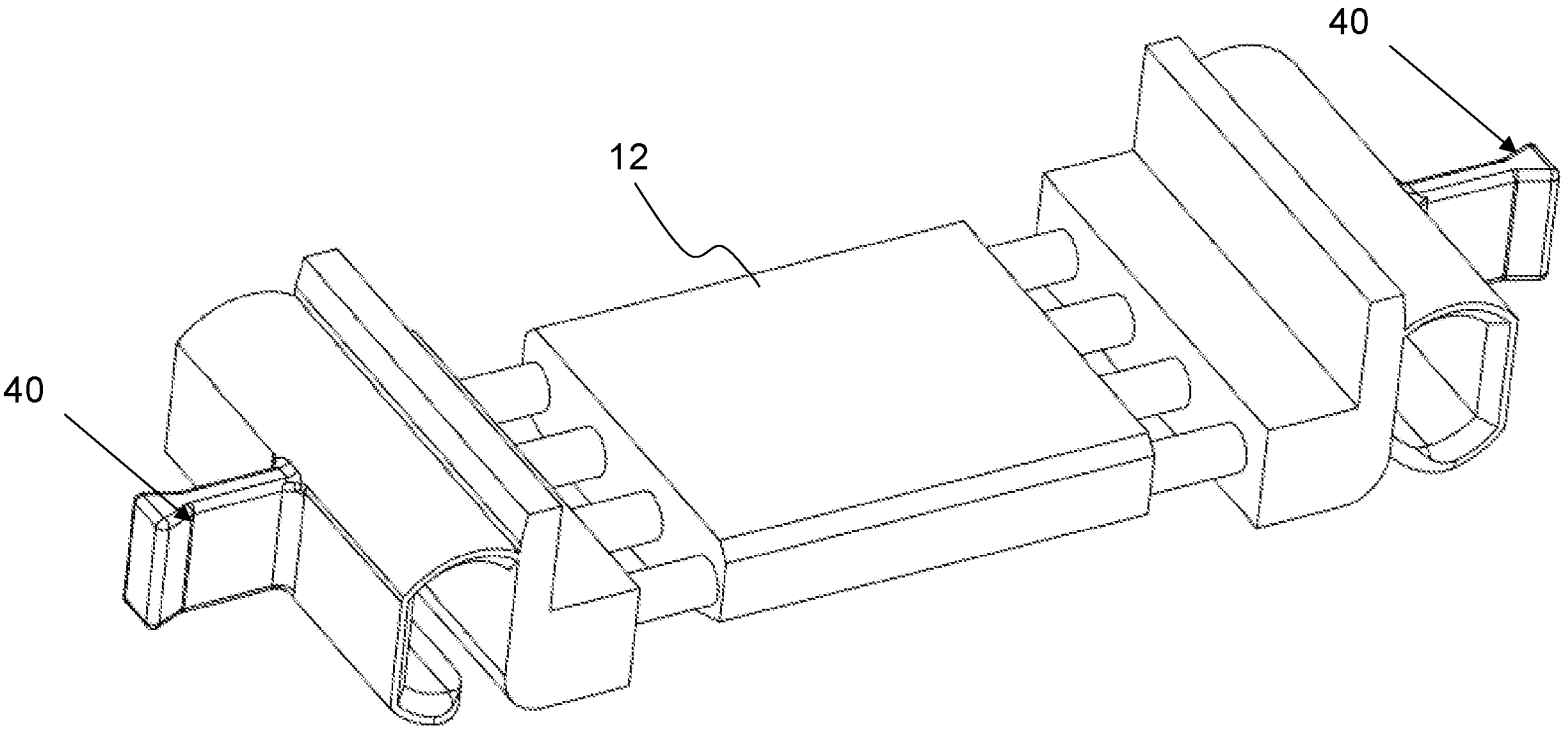
FIGS. 4A-4C are drawings of an embodiment of the attachment component 16 of a bow restricting device 10.
Figure 4B:
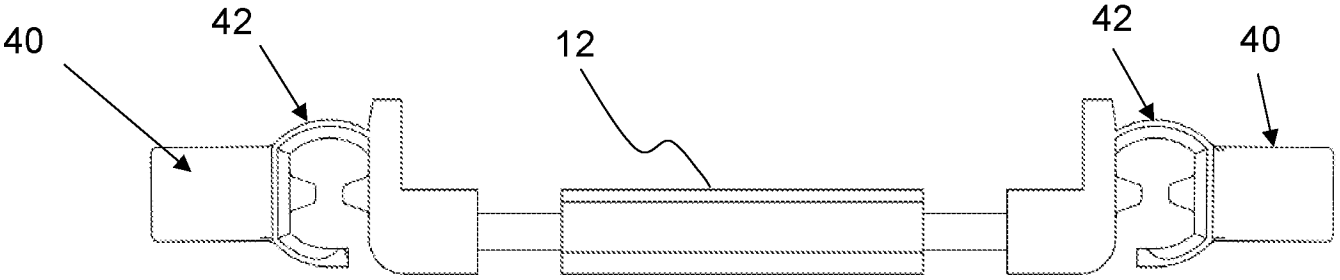
Figure 4C:
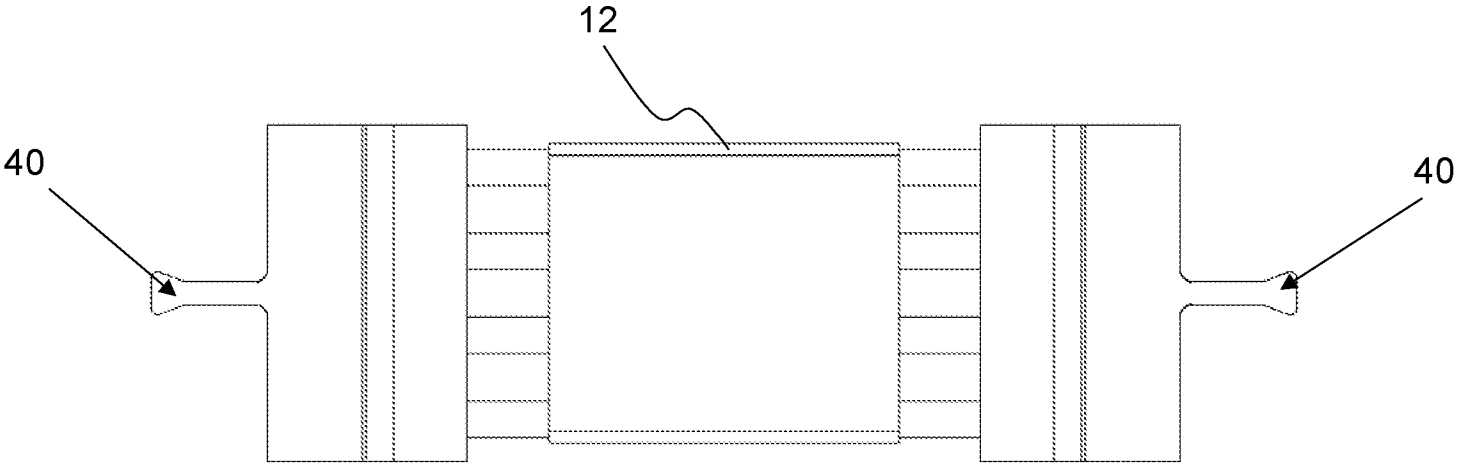

Turning now to FIGS. 4A-4C, which show drawings of a variety of views of the preferred embodiment of the attachment component 12. The attachment component 12 can be expanded or contracted to fit securely to the sides of the fingerboard 13 of a variety of stringed instruments 11 without damage. One or two restricting rods 14 can slide into channels 42 located within the attachment component 12. The restricting rods 14 are held in place with locking tabs 40 on the sides of the channels 42. The locking tabs 40 can be engaged or disengaged by the player when inserting or removing the restricting rods 14 to secure them in place.

Figure 5A:
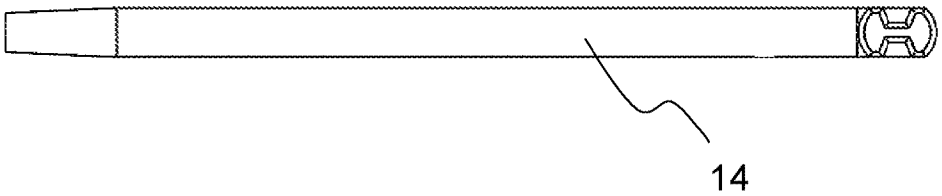
FIGS. 5A & 5B are drawings of embodiments of restrictor rods 14.
Figure 5B:
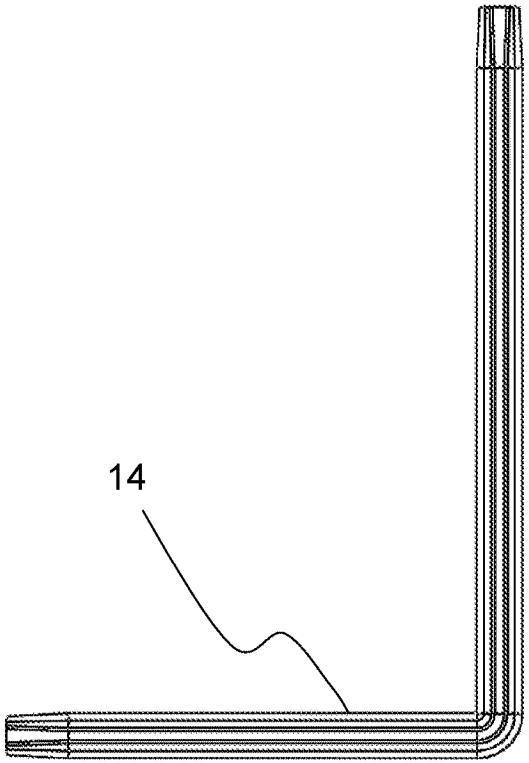

Turning now to FIGS. 5A & 5B, which show drawing of embodiments of restricting rods 14. Preferred embodiments of the restricting rods 14 are "L" shaped as illustrated in FIG. 5B, but a variety of shapes could be used to achieve the same effect. The outside geometry of the restricting rods 14 match the interior geometry of the channels 42 of the attachment component 12 for a secure fit. The exterior surface of the restricting rods 14 are smooth with no protrusions to allow a bow to smoothly glide against them when playing a stringed instrument 11.

Those skilled in the art will recognize that the restricting rods 14 displayed in FIGS. 5A & 5B represent one embodiment and restricting rods 14 of varying sizes and shapes can be used to achieve the same effect.

Figure 6A:
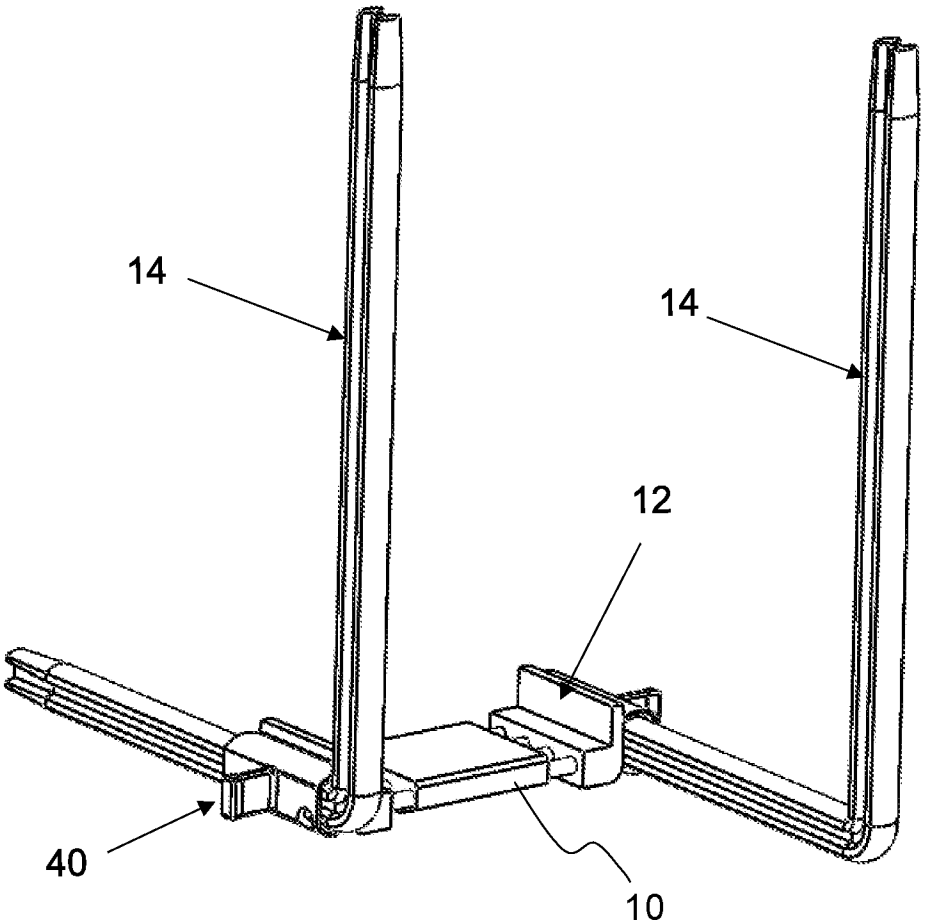
FIG. 6A-6C are drawings of alternate views of an embodiment of the bow restricting device 10.

Turning to FIG. 6A, which shows a drawing of an example configuration of a preferred embodiment of the bow restricting device 10. In this configuration, two restricting rods 14 are placed along the attachment component 12 to allow a bow to glide between them during use of a stringed instrument 11. The restricting rods 14 can be manipulated with the locking tab 40 to the preferred position by the player as described above.

Figure 6C:
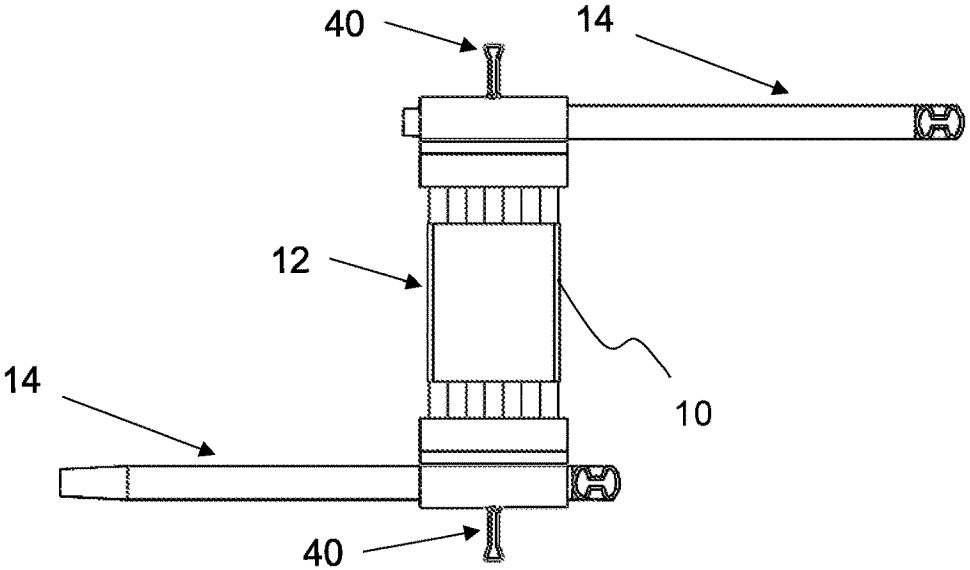
Figure 6B:
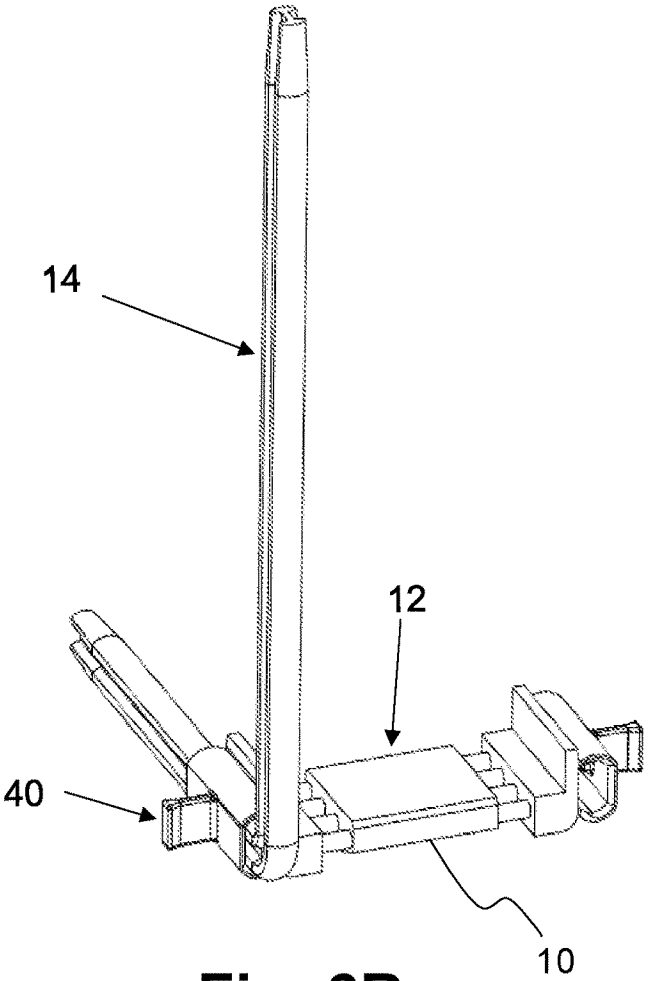

In FIG. 6B, there is shown another example configuration of a preferred embodiment of the bow restricting device 10. One restricting rod 14 is placed in a position in the attachment component 12 and locked with the locking tab 40 to prevent the bow from drifting beyond the fingerboard of the stringed instrument 11.

Turning now to FIG. 6C, there is shown another example configuration of an embodiment of the bow restricting device 10 viewed from the bottom of the device. In this configuration, two of the restricting rods 14 (seen in FIG. 5A) are inserted into the attachment component 12 and are held in place with the locking tabs 40. Those skilled in the art will recognize that FIGS. 6A-6C are for illustrative purposes and only represent three examples of configurations that are possible of many.

Alternative Embodiments

Figure 7B:
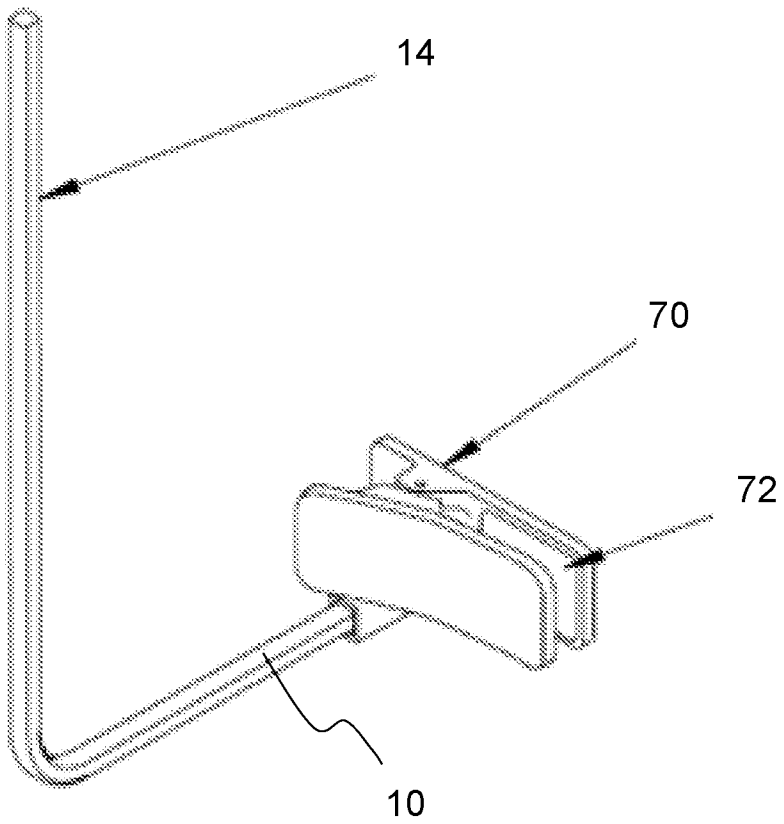
FIGS. 7A & 7B are drawings of an alternate embodiment of the bow restricting device 10.
Figure 7A:
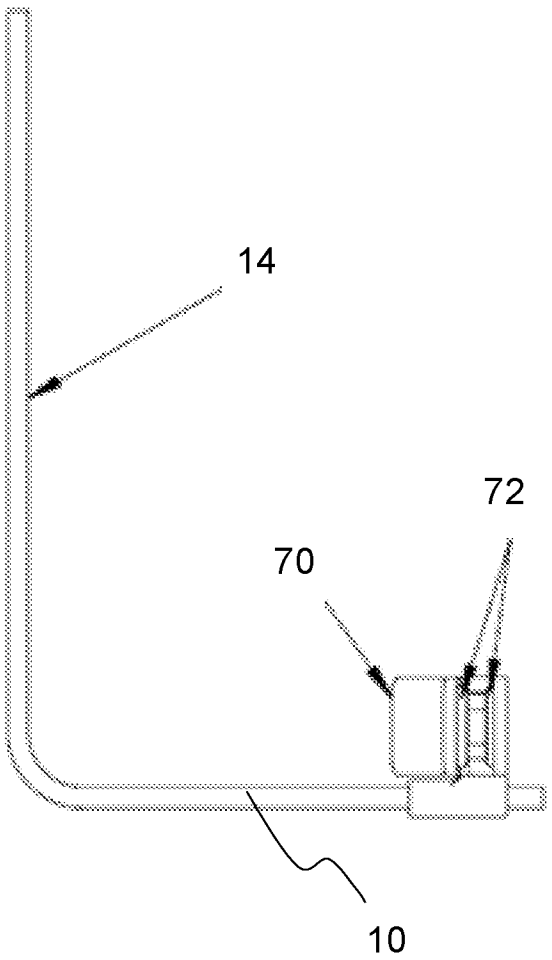

Turning to FIGS. 7A & 7B, there is shown an alternative embodiment of the bow restricting device 10. Instead of the attachment component 12, described in detail above, this embodiment uses a spring-loaded clamp 70. The spring-loaded clamp 70 allows the device 10 to be attached quickly and easily to a fingerboard 13 of a stringed instrument 11. There are two rubber pads 72 on the spring-loaded clamp 70 to prevent any damage to the stringed instrument 11 when attaching or removing. The rubber pads 72 also aid in preventing the bow restricting device 10 from slipping or sliding from the fingerboard 13 when in use. There is one restricting rod 14, which is an "L" shape in this configuration to prevent the bow from drifting onto the fingerboard 13 when playing the stringed instrument 11.

Figure 8A:
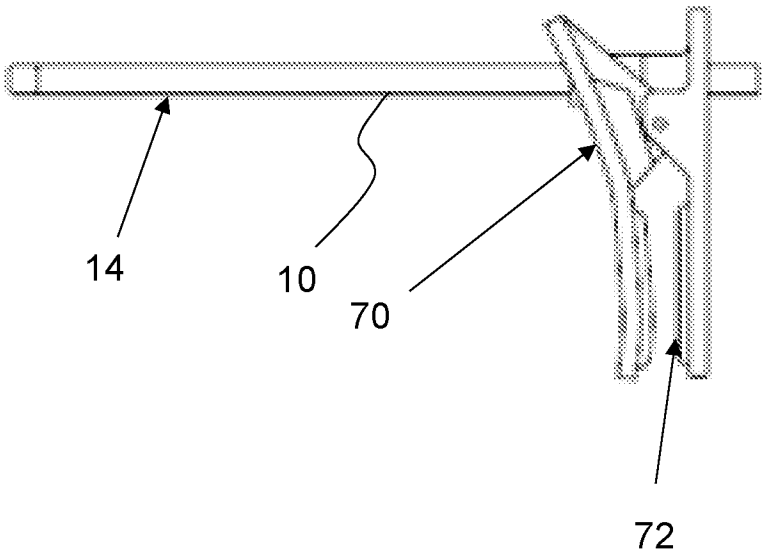
Figure 8A:
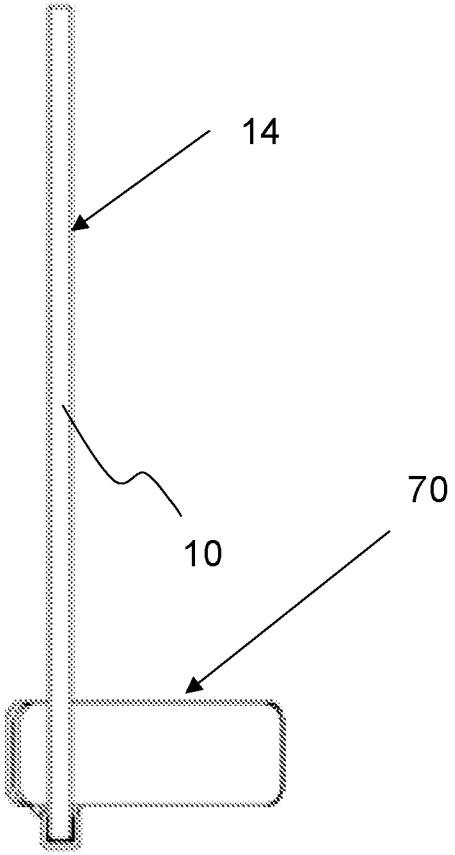

Turning to FIGS. 8A & 8B, there is shown another alternative embodiment of the bow restricting device 10. The spring-loaded clamp 70 with rubber pads 72 attached to a straight restricting rod 14.

The figures and descriptions in this application depict specific examples to teach those skilled in the art how to make and use the best mode of the invention. These examples are not given to limit the scope of the invention, but rather to teach inventive principles. To concisely teach inventive principles, some conventional aspects of the invention have been simplified or omitted. Those skilled in the art will appreciate many of the configurations, combinations, subcombinations, and variations on these examples that fall within the scope of the invention. For example, certain features of the invention described in separate embodiments can also be implemented in combination in a single embodiment. Conversely, various features that are described in the context of a single embodiment can also be implemented in multiple embodiments—separately or in any suitable subcombination. The invention is not limited to the specific illustrative examples described herein, but by all embodiments and methods within the scope and spirit of the invention as in the current, amended, or added claims and their equivalents. In any case, all substantially equivalent systems, articles, and methods should be considered within the scope of the invention.

We claim:

1. A device for attaching to the fingerboard of a stringed instrument, comprising:

an attachment device configured to fit securely to said fingerboard of said stringed instrument;

one or more receptacles within said attachment device configured to securely hold a rod; and a rod configured to be inserted into each of said receptacles of said attachment device to provide one or more adjustable barriers for a bow when playing said stringed instrument;

wherein each rod comprises a first arm and second arm connected to form in a general L-shape, wherein:

the first arm is coupled with the receptacle, the second arm is positioned to prevent movement of the bow, while being played on strings of the stringed instrument, past the second arm in a first direction or a second direction, the first direction and second direction being substantially parallel with the length of the strings, and the second arm is positioned to allow the bow, while being played on the strings, unrestricted outward movement away from the strings in a third direction substantially perpendicular to the first direction and the second direction, wherein the third direction is substantially parallel with a height dimension of a bridge of the stringed instrument.

2. The device of claim 1, wherein said receptacles contain a locking mechanism for securing said rods.

3. The device of claim 1, wherein said device is primarily composed of Acrylonitrile butadiene styrene.

4. The device of claim 1, wherein said attachment device is a spring-loaded clamp with rubber pads.

5. The device of claim 1, wherein said attachment device can be expanded or retracted to fit a variety of fingerboards of stringed instruments.

6. The device of claim 1, wherein said restricting rod is shaped in a manner that matches said receptacle for a secure fit.

7. A device for attaching to the fingerboard of a stringed instrument, comprising:

a) a spring-loaded clamp configured to be coupled with a top side and a bottom side of the fingerboard of the stringed instrument wherein the top side faces the strings and the bottom side faces the body of the instrument, wherein said spring-loaded clamp has rubber pads on each side of said spring-loaded clamp;

b) one or more receptacles within said spring-loaded clamp configured to securely hold a rod; and c) wherein each rod is inserted into one of said receptacles of said attachment device to provide one or more adjustable barriers for a bow when playing said stringed instrument.

8. The device of claim 7, wherein said device is primarily composed of Acrylonitrile butadiene styrene.

9. The device of claim 7, wherein said one or more rods have a general L-shape.

10. The device of claim 7, wherein one or both of said rods are geometrically straight.

11. The device of claim 7, wherein said one or more rods have a smooth surface with no protrusions to allow a bow to smoothly glide against when playing the stringed instrument.

12. The device of claim 7, wherein said device contacts the stringed instrument only the fingerboard of said stringed instrument.

13. A device for attaching to the fingerboard of a stringed instrument, comprising:

a clamp configured to fit securely to of the fingerboard of stringed instrument, wherein said clamp has a rubber pad on each side of said clamp;

one or more receptacles within said clamp configured to securely hold a rod;

wherein:

each rod consists only of a first arm which has a geometry that matches the interior of the receptacle and a second arm which provides a barrier configured to allow a bow to glide smoothly against, and which the first and second arm form in a general L-shape;

the first arm is coupled with the receptacle and prevents parallel movement along the strings of the stringed instrument of the bow below a first point, and the second arm is coupled with the receptacle and positioned to prevent parallel movement along the strings of the stringed instrument of the bow above a second point; and the combination of the first arm and the second arm are configured to form an area between the first arm and the second arm which allows for freedom of movement in any direction within the area.

14. The device of claim 13, wherein, for each of the rods, the first arm and the second arm each have a smooth surface with no protrusions to allow a bow to smoothly glide against when playing the stringed instrument.

15. The device of claim 13, wherein, for each of the rods, both of said arms are geometrically straight.

16. The device of claim 13, wherein said device contacts the stringed instrument only at the fingerboard of said stringed instrument.

17. The device of claim 13, wherein, for each of the rods, the second arm comprises:

a proximal end attached with the first arm; and a free distal end with an outer-facing surface on an outer-most end of the distal end, the outer-facing surface disposed on the distal end to face in an outer direction substantially perpendicular to the length of the first arm and substantially parallel with a height direction of a bridge of the instrument.

* * * * *